United States Patent [19]

Isoard

[11] 4,203,560

[45] May 20, 1980

[54] PROCESS AND DEVICE FOR THE WINDING-UP OF TEXTILE YARN

[75] Inventor: Bernard Isoard, Ecully, France

[73] Assignee: Rhone-Poulenc-Textile, Paris, France

[21] Appl. No.: 760,451

[22] Filed: Jan. 18, 1977

[30] Foreign Application Priority Data

Jan. 20, 1976 [FR] France ..... 76 01767

[51] Int. Cl.[2] ..... B65H 59/38

[52] U.S. Cl. ..... 242/45; 242/18 DD

[58] Field of Search ..... 242/45, 75.5, 75.51, 242/75.53, 18 DD

[56] References Cited

U.S. PATENT DOCUMENTS

| | | | |
|---|---|---|---|
| 2,950,067 | 8/1960 | Keith | 242/45 X |
| 4,043,517 | 8/1977 | Jahrig | 242/45 X |

FOREIGN PATENT DOCUMENTS

| | | | |
|---|---|---|---|
| 86672 | 12/1971 | Fed. Rep. of Germany | 242/45 |
| 1238700 | 7/1960 | France | 242/45 |
| 926567 | 5/1963 | United Kingdom | 242/45 |

*Primary Examiner*—Stanley N. Gilreath

*Attorney, Agent, or Firm*—Sherman & Shalloway

[57] ABSTRACT

The invention relates to a process and a device for the winding-up of textile yarn.

The process includes winding-up by double drive, namely peripheral and axial drive, according to which, in a first phase, the torque supplied by the axial drive is decreased progressively to zero, and in a second phase, the rotation of the take-up package is effected by the single peripheral drive.

Preferably, the device used is a gas turbine, the inlet pipe to which is progressively obstructed.

The invention applies to winding-up of chemical textile yarns.

6 Claims, 3 Drawing Figures

PROCESS AND DEVICE FOR THE WINDING-UP OF TEXTILE YARN

BACKGROUND OF THE INVENTION

The present invention relates to a process and a device for winding-up textile yarns. In particular, it relates to a process and a device for winding-up continuously delivered yarn, such as winding-up after spinning, at speeds which can attain high values in the range of 6,000 to 7,000 meters/minute and higher.

Wind-up devices or winding machines exist, based on the principle of axial drive. The take-up package is subjected to an axial drive by means of the spindle which supports it. This type of drive allows high torques to be transmitted. However, the control of the peripheral speed of the take-up package, as it increases in size, requires complicated approaches.

Winding machines based on the principle of peripheral drive exist. With these machines, the take-up package is subjected to a peripheral drive by tangential frictional contact with a pilot roller. Rotating at constant speed, the pilot roller controls the peripheral speed of the take-up package in a simple manner and supplies the torque necessary to drive it. However, at high speed, and/or when the torque to be transmitted is high, undesirable slippage between the pilot roller and the take-up package may occur. This slippage results in an irregular take-up speed, variations in tension and heat generation, which leads to a deterioration of the surface filaments.

Winding machines exist which are based on the double drive principle, according to which the take-up package is subjected to a peripheral drive by tangential frictional contact with a pilot roller and to an axial drive by means of the spindle which supports it. The pilot roller, which rotates at constant speed, controls the peripheral speed of the take-up package and can provide part of the torque necessary to drive it, the axial drive providing the remaining torque. A winding machine with axially assisted drive is thus obtained.

For the axial drive, a motor capable of slipping is used such as, for example, a gas turbine. Double drive is advantageous, since it makes it possible for the torque transmitted by the pilot roller to be reduced in the desired proportions and, hence, to avoid the undesirable phenomena of slippage between the pilot roller and the take-up package.

The ratio between the value of the torque supplied by the pilot roller and that of the torque supplied by the axial drive can vary within wide limits according to the circumstances, one of the two values being able to be very small relative to the other. This ratio may be variable during the winding-up process; for example, the value of the torque supplied by the axial drive may be reduced.

In this regard, published Japanese Application Number 49/8,823 describes a winding machine with double drive, namely peripheral and axial drive, with the axial drive supplied by an air turbine, in which the pressure of the air supplied to the turbine is diminished as the take-up package increases in size. The object of this process is to adapt the torque supplied by the turbine to the decrease in the angular speed of the take-up package, in such a way that the turbine always drives the take-up package at the same peripheral speed, which is slightly less than that of the pilot roller. To this end, a pressure regulator is used. In this patent, the diminishing torque from the turbine is retained until the end of the take-up operation.

In many cases, it has been found that slippages occur only at the beginning of formation of the take-up package, and then disappear when the take-up package has attained a certain size.

Indeed, contact between the take-up package and the pilot roller is maintained by means of pressure applied either to the take-up package or to the pilot roller. Due to this pressure, the external surface of the take-up package, which is soft relative to that of the pilot roller, becomes deformed by being crushed and assumes the shape of the pilot roller. The contact between take-up package and pilot roller is not effected along a generatrix, as would be the case for two indeformable rollers, but over an area. At the beginning of the winding-up operation, and as long as the layer of yarn is relatively thin, the take-up package, which is received on a hard support, deforms to a small extent; the contact area is, therefore, small and does not allow the transmission of a high torque without slippage. As the take-up package increases in size, a soft and deformable layer of yarn comes between the hard support and the pilot roller. The deformation of the take-up package in contact with the pilot roller becomes large. The contact area increases until it becomes sufficient to transmit, without slippage, all the torque necessary for the drive. The axial assistance is no longer necessary.

SUMMARY OF THE INVENTION

The present invention has the object of providing a new winding-up process suitable for the working conditions described above.

It relates to a process for winding-up textile yarn by peripheral drive, and axial drive using diminishing torque, characterized in that the process of formation of the take-up package comprises a first phase of double drive, namely peripheral and axial, itself comprising a period during which the torque provided by the axial drive is progressively reduced to zero, and a second phase during which the rotation of the take-up package is effected by means of the peripheral drive only.

In the first phase, the point from which the torque supplied by the axial drive is decreased, and the point at which the said torque becomes zero, are advantageously predetermined by carrying out experiments according to the type of take-up package produced.

Indeed, experiments have shown that abruptly shutting off the axial drive during winding-up produces faults on the sides of the take-up packages. These faults, which create a discontinuity in the take-up package, which is detrimental to the quality of the yarn, are the consequence of the abrupt change in tension resulting from the abrupt shutting-off of the axial assistance.

On the other hand, if the axial assistance is carried on beyond the time necessary, there is a wasteful expenditure of energy.

The preferential method of assistance used in the invention is a gas turbine, advantageously driven by compressed air. In this case, the progressive reduction in the axial drive torque is carried out by reducing the supply pressure, achieved by the simple expedient of progressively closing the supply line.

The invention also relates to a device for implementing the process.

This is a device for winding-up textile yarn, by winding onto a support which is mounted on a bobbin carrier, with peripheral drive for the take-up package and axial assistance from a gas turbine, characterized in that the means of supplying the gas to the turbine comprise a straight-through valve equipped with a progressively restricting device and means of controling the restricting device in accordance with the increase in size of the take-up package. The restricting device, as well as the means of controling it in accordance with the increase in size of the take-up package, can be made in different forms.

The restricting device can be, for example, a mechanical component which is introduced into the valve passage and which progressively obstructs it. It can also be a pliable, deformable, annular membrane bounding the valve passage and being compressed radially in a progressive manner by constriction. The means of controling the restricting device can be of any type: electrical, electromagnetic, electronic, pneumatic or mechanical. The controls act in accordance with the increase in size of the take-up package, either through a mechanical part set in motion at the time of the increase in size (for example, a bobbin carrier), or through a program consistent with the program of assistance that it is desired to apply to the take-up package.

According to a first preferential embodiment, the valve comprises a valve body provided with a space, cylindrical in form, for the passage of fluid, into which space lead the inlet and outlet pipes, the restricting device comprising a piston which moves in the space for the passage of fluid according to the relative movement between the bobbin carrier and the pilot roller, the piston being displaced by means of a mechanical link with the mobile component, which comprises, according to the type of winding machine, the bobbin carrier or the pilot roller.

For example, in the case where the bobbin carrier is supported by a pivoting arm, the two components comprising the piston and the valve body can be hinged, one on the pivoting arm and the other on a fixed point on the winding machine.

According to another embodiment, the cylindrical space for the passage of fluid is bounded by an annular deformable membrane, which is radially compressible under constriction by means of a control gas (for example, compressed air), supplied under pressure to a chamber which surrounds the membrane. The deformation of the membrane is proportional to the pressure; the latter can be varied by passing the control fluid through a variable effect flow reducer, pre-adjusted to conform to a pre-established program of assistance.

However, the invention will be better understood with the help of the following examples, which are given by way of illustration but which do not imply a limitation.

DETAILED DESCRIPTION

Figure 1:
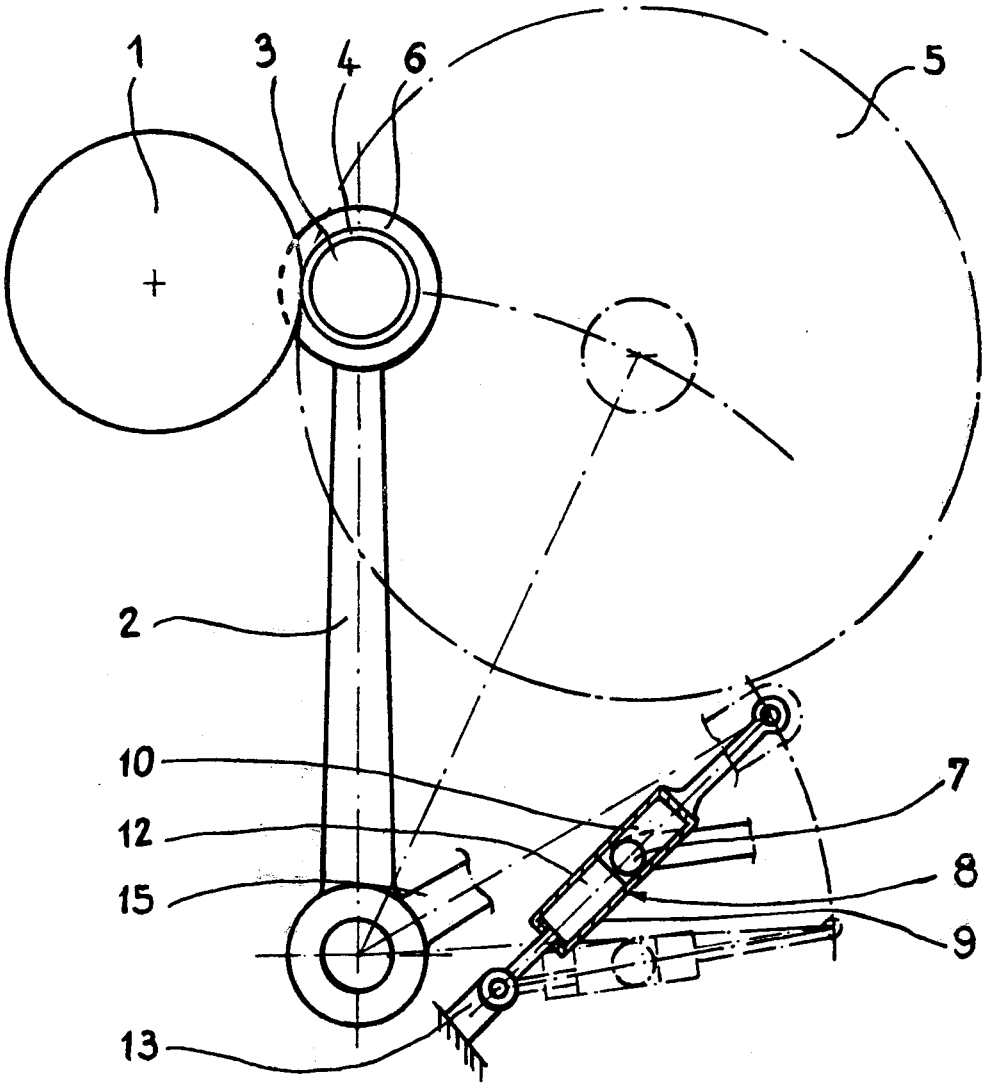
FIG. 1 is a schematic front view of an embodiment of the winding machine according to the invention, with axial assistance by means of a turbine.
Figure 2:
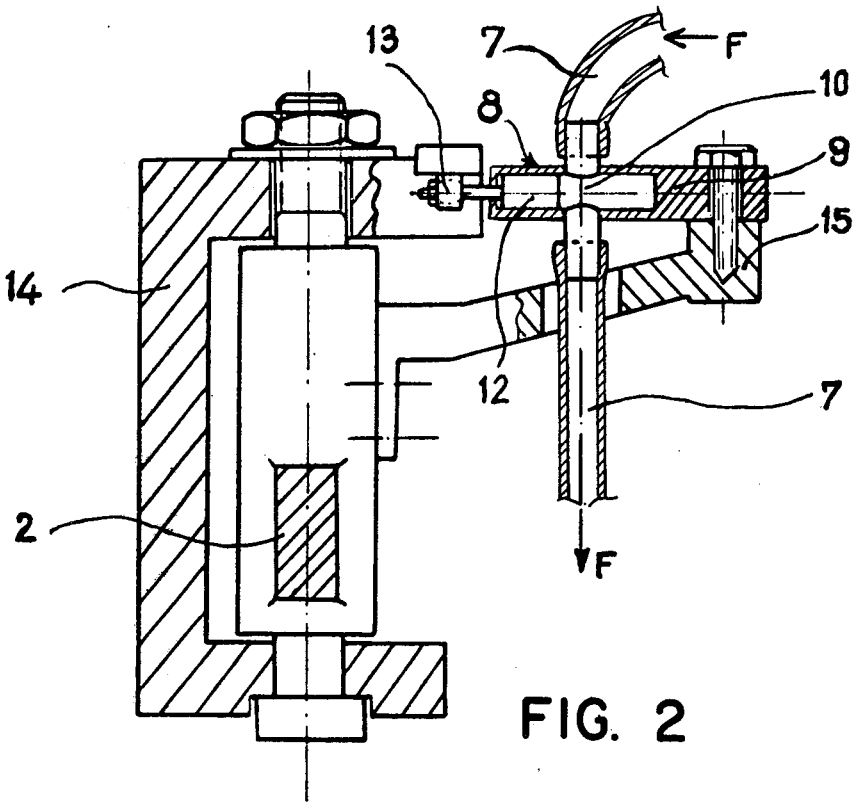
FIG. 2 is a part sectional view from above of the winding machine according to FIG. 1.

The winding machine according to FIGS. 1 and 2 comprises a pilot roller 1, driven to rotate at constant speed by an electric motor which is not shown, a pivoting arm 2 is provided, at one of its ends, with a bobbin carrier 3, which carrier supports a tube 4 onto which the yarn must be wound to constitute a take-up package 5 represented by the broken lines in FIG. 1. A compressed air turbine 6 is mounted directly on the axis of the bobbin carrier 3 in order to assist its rotation. The compressed air supply to the turbine is provided by a pipe 7. Into pipe 7 is inserted a straight-through valve 8. The valve 8 comprises a valve body 9 in which is provided a cylindrically-shaped space 10 for the passage of fluid. Into the space 10 for the passage of fluid lead two branches of the pipe 7, one for an air inlet and one for the outlet to the turbine. The valve 8 is provided with a restricting device which can progressively restrict the space 10 for the passage of fluid. It comprises a piston 12 which moves according to the movement of the bobbin carrier. The end of the shaft connected to the piston 12 is hinged at a point 13 on the framework 14 of the winding machine, whereas the body of the valve is hinged to an extension 15 of the pivoting arm 2. Thus, a system of restriction has been made which is linked to the movements of the pivoting arm.

Method of Operation

During the increase in size of the take-up package, the relative movements of the piston 12 and of the valve body 9 produce a progressive restriction of the space 10 for the passage of fluid. With the air flowing in the direction of the arrows F, by means of a pressure drop a decrease of pressure in pipe 7 is created, downstream from valve 8, and a progressive decrease in the axial assistance torque is created. When the space 10 for the passage of fluid is totally restricted (broken lines in FIG. 1), the axial assistance is zero.

The start and finish of the valve closure are determined by the geometry of the restricting system, the latter having been designed accordingly. The shape of the damping curve (reduction speed) is determined both from the geometry of the restricting system and from the shape of the piston head. For a given geometry, it is possible to vary the speed of reducing the assistance by modifying the shape of the piston head. The latter can be of any desired shape, for example, flat, convex, pointed or cut to a chamfer according to a complex profile and the like. Advantageously, the piston is interchangeable. Thus, by mounting pistons 12 with different head shapes, it is easy to change the shape of the damping curve and to adapt it to the type of take-up package produced.

Figure 3:
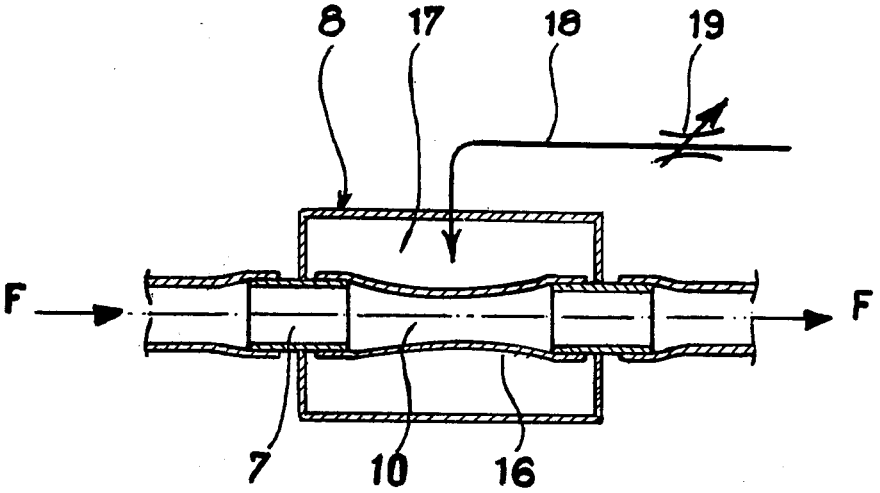
FIG. 3 is a schematic view of another embodiment of the means of supplying the turbine of a winding machine according to the invention.

FIG. 3 represents another embodiment of the valve 8 with its system of restriction. The valve 8 is mounted on pipe 7 which supplies fluid to the turbine, as in the example given above. The space 10 for the passage of gas is bounded by an annular, flexible membrane 16, which is capable of being compressed radially by constriction to the point where total obstruction of the space 10 for the passage of gas occurs. The membrane 16 is surrounded by a chamber 17 to which is supplied compressed air at variable pressure. The air is supplied by a pipe 18 through a flow reducer 19, which allows the flow of air into the chamber 17 to increase during the first phase of the formation of the take-up package. When the flow increases, the pressure is increased in the chamber 17, leading to the progressive constriction of the membrane 16 and a corresponding reduction in the flow through the pipe 7, until the total closure of the space 10, as determined by the end of the axial assistance phase. The flow reducer, which is of a common type, is pre-adjusted in order to provide a program for the air input to the turbine consistent with the assistance program.

Example of Method of Operation

Using the winding machine according to FIGS. 1 and 2, a take-up package of polyester yarn, 167 dtex/30 strands, is prepared on a tube of external diameter 70 mm, at a winding-up speed of 3,500 meters/minute. When the take-up package is finished, it has a diameter of 280 mm and a weight of 18 kg. The air begins to be shut off at a diameter of 100 mm when the take-up package weighs approximately 1 kg, and is stopped at a diameter of 150 mm when the take-up package weighs approximately 4.5 kg. The axial assistance operates during approximately 1/5 of the time necessary for winding. The consumption of compressed air is divided by 5.

A saving of air of 20 $Nm^3/h$ ($m^3/h$ at normal temperature) per spindle has been effected, relative to the case where assistance takes place throughout the formation time of the take-up package, normal consumption in this case being 25 $Nm^3/h$ at 3,600 meters/minute.

The examples of design and operation illustrate the advantages of the invention, namely, good winding-up conditions eliminating the risk of poor quality and of yarn deterioration, energy saving, suppression of waste, and good adaptability to different types of take-up packages.

Obviously, with respect to the device, the invention is not limited to the examples described, but covers all possible variants. These variants relate both to the method of producing the restricting device as well as the method of controling it. Thus, the said control could be other than mechanical or pneumatic (for example, electrical, electromagnetic, electronic, and the like). Likewise, in the case of mechanical control, the control may take different forms which may vary according to the geometry of the winding machine.

The present invention is applicable to the winding-up of yarns of all types (continuous filament yarn and spun fiber yarn), of any nature (natural fibers, chemical fibers, and mineral fibers), and of any gauge.

It is particularly suitable for the winding-up of artificial yarns delivered continuously at high speed, namely speeds of 6,000 to 7,000 meters/minute and higher.

I claim:

1. A winding machine for winding-up textile yarn in a take-up package comprising:

at least one yarn support mounted on a bobbin carrier;

a pilot roller continuously peripherally driving the take-up package until the package reaches a final size;

a gas turbine for axially driving the yarn support;

through means for supplying gas to the turbine through a straight-through valve which is equipped with a gas progressive restricting device which slectively restricts gas flow through the valve; and means for controlling the restricting device in accordance with the increase in size of the take-up package to progressively reduce gas flow through the valve to zero as the size of the take-up package increases, said means for controlling reducing the gas flow through the valve to zero when the size of the take-up package reaches a predetermined size which is less than the final size of the take-up package, whereby the axial drive provided to the yarn support by the gas turbine is progressively reduced to zero as the size of the take-up package approaches the predetermined size.

2. The winding machine according to claim 1, wherein the restricting device is a movable component and the means for controlling the movable component includes a mechanical link between the restricting device and a mobile part which mobile part serves as the bobbin carrier.

3. The winding machine according to claim 2, wherein the bobbin carrier is supported on a pivoting arm, and wherein the straight-through valve and the restricting device are separately hinged, one to the pivoting arm and the other to a fixed point on the winding machine.

4. The winding machine according to claim 3, wherein the restricting device comprises an interchangeable piston, whose head can be of various shapes to produce a predetermined, desired damping curve of the torque of the gas turbine.

5. The winding machine according to claim 1, wherein the restricting device is a flexible annular membrane which can be deformed by constriction and surrounds the valve passage, and wherein the means for controlling the membrane comprises a variable pressure gas input to a chamber surrounding the flexible membrane.

6. The winding machine according to claim 5, wherein the gas input is effected through a flow reducer pre-adjusted in accordance with a program for air input to the turbine which corresponds to a predetermined damping curve of axial torque supplied by the gas turbine.

* * * * *